United States Patent [19]

Akami et al.

[11] Patent Number: 4,975,718

[45] Date of Patent: Dec. 4, 1990

[54] INK JET RECORDING APPARATUS

[75] Inventors: Kenji Akami, Kawasaki; Gen Oda, Ebina; Toshiyuki Iwasawa, Tama; Masayoshi Miura, Kawasaki, all of Japan

[73] Assignee: Matsushita Electric Industrial Co., Ltd., Osaka, Japan

[21] Appl. No.: 239,741

[22] Filed: Sep. 2, 1988

[30] Foreign Application Priority Data

Sep. 3, 1987 [JP] Japan ..... 62-220734
Sep. 17, 1987 [JP] Japan ..... 62-232840

[51] Int. Cl.[5] ..... B41J 2/06
[52] U.S. Cl. ..... 346/140 R
[58] Field of Search ..... 346/140

[56] References Cited

U.S. PATENT DOCUMENTS 4,050,377 9/1977 Watanabe ..... 346/75 X
4,223,324 9/1980 Yamamori ..... 346/140
4,245,226 1/1981 Paranjpe ..... 346/75
4,622,562 11/1986 Pipkorn ..... 346/75
4,736,212 4/1988 Oda ..... 346/140

FOREIGN PATENT DOCUMENTS 0201955 10/1985 Japan .

*Primary Examiner*—Joseph W. Hartary
*Attorney, Agent, or Firm*—Wenderoth, Lind & Ponack

[57] ABSTRACT

An ink nozzle plate has ink discharge channels for discharging ink, and an air nozzle plate has air discharge channels facing the ink discharge channels for discharging air to jet the ink. A power source produces an electric field through the ink at the ink discharge channels, thereby extending the ink meniscus, and the ink is jetted from the air discharge channels by air-flow and the electric field. A heating means increases the temperature of the air nozzle plate, thereby vaporizing water adsorbed in the air discharge channels and stabilizing the ink jet volume.

5 Claims, 6 Drawing Sheets

(PRIOR AIR)

INK JET RECORDING APPARATUS

BACKGROUND OF THE INVENTION

1. Field of the Invention

The present invention relates to an ink jet recording apparatus for recording characters, figures or images on a recording medium by jetting ink droplets, utilizing electrostatic force and air streams.

2. Description of the Prior Art

Hitherto, the ink jet recording apparatus utilizing electrostatic force and air streams is known in USP 4,403,234 (EP 63,853), USP 4,403,228 (EP 61,327), USP 4,736,212 and so on. The conventional ink jet recording apparatus utilizing electrostatic force and air streams is described as follows, referring to FIG. 1.

In FIG. 1, a body 13 is provided with an air nozzle plate 2 formed of an insulating material. The air nozzle plate 2 has a plurality of air discharge channels 1. An ink nozzle plate 14 is provided in parallel with the air nozzle plate 2 and has a plurality of ink discharge channels 4 which are arranged facing the plurality of air discharge channels 1, respectively.

Convex part 17, projecting in the direction of the air discharge channel 1, is formed around the ink discharge channel 4. Between the convex parts 17 neighboring each other, a projection 5 is formed on the ink nozzle plate 14 in order to stabilize air flow. Air flows into an air supply passage 8 from an air source 3, is made uniform in a circular air chamber 9, and further flows into an air passage 7 between the air nozzle plate 2 and ink nozzle plate 14 and finally flows out from the air discharge channels 1.

The air expands at the air discharge channel 1 and therefore a sharp air pressure gradient appears in a space between the ink discharge channel 4 and the air discharge channel 1. An ink chamber 10 neighboring the ink discharge channels 4 is connected to an ink tank 11 through an ink supply passage 6. Ink in the ink tank 11 is applied with pressure by the air pressure of the air source 3, the air pressure being regulated by an air pressure regulating valve 16.

The reason for the air pressure regulation is that it is necessary to maintain a meniscus of ink formed at the ink discharge port 4 static by nearly equalizing the air pressure near the ink discharge channel 4 to the ink pressure of the ink discharge channel 4, or the ink tank 10, when the ink jet recording apparatus is not driven.

Bias electric source 24 is connected to a common electrode 12 provided around the air discharge channels 1 and a plurality of signal sources 22 are connected to control electrodes 15 provided on the surface of the ink nozzle plate 14 facing the ink chamber 10, around the ink discharge channels 4. Since the ink is conductive, the sum of the bias voltage and the signal voltage is applied between the common electrode 12 and ink of the ink discharge channel 4. The meniscus of ink formed at the ink discharge channel 4 is extended toward the air discharge channel 1 by the electrostatic force produced by the voltage.

Further, since there is the sharp pressure gradient in the space between the ink discharge channel 4 and the air discharge channel 1, when the ink meniscus of the ink discharge channel 4 is the proper length, the ink meniscus jets out from the air discharge port 1.

The conventional ink jet recording apparatus has the problem that ink jet volume decreases when atmospheric (room) temperature is 25° C. and relative humidity is 60% or more. Reasons for the ink jet volume decrease are described as follows. FIG. 2(*a*) shows the electric field when ink jets normally. The air nozzle plate 2 is made of photosensitive glass with a dielectric constant of 6.54.

On the other hand the dielectric constant of air is about 1 and therefore the strength of the electric field in the air is larger than that of plate 2. The electric field which is strong and therefore particularly contributes to the extension of the ink meniscus 21, is shown by electric line of force 18.

The electric line of force 18 is produced through the air discharge channel 1, from the common electrode 12 to ink meniscus 21. Since the direction of the electric line of force 18 and the direction of ink jetting are the same, the electric field effectively extends the ink meniscus 21. FIG. 2(*b*) shows the electric field when ink jet volume decreases. When the relative humidity is 60% or more, water (moisture, vapor) 20 is adsorbed into the wall of the air discharge port 1.

The specific resistance of the water is $2.5\times10^7\ \Omega$ cm, namely, conductive, so that the voltage of the water 20 becomes equal to that of the common electrode 12. In FIG. 2(*b*), the line of electric force 19, which indicates the strong electric field, is produced between the ink meniscus 21 and the water 20 which is nearer to the ink meniscus 21.

In such a case, the direction of ink jet and the direction of the line of electric force are not equal to each other, and therefore the force of the electric field is not concentrated. As a result, the ink meniscus 21 is not efficiently extended and the ink jet volume decreases.

Further, since the electric field is not stable, the ink volume varies. The reason why the water 20 is adsorbed is described as follows. Considering the air discharge channel 1 with air flowing therethrough, the air pressure decreases in the air discharge channel 1 and air volume expands when the air at 0.12kg/cm$^2$ in the air passage 7 exits to the atmosphere (0 kg/cm$^2$). When the air rapidly expands, the air absorbs heat from the wall of the air discharge channel 1, and therefore the temperature of the wall of the air discharge channel 1 decreases. Since the temperature of the wall of the air discharge channel 1 is lower than or equal to the flowing air, the wall of the air discharge port 1 tends to adsorb water from the atmosphere. Table 1 shows conditions of temperature and humidity where the ink volume decreases, varies and becomes unstable in a thermo-hygrostat.

TABLE 1

| atmosphere temperature | relative humidity in the room |
|---|---|
| 20° C. | 65% or more |
| 25° C. | 60% or more |
| 30° C. | 55% or more |
| 40° C. | 60% or more |

The air flowing out from the air discharge channel 1 is air from the room supplied from the air source 3, which is, for example, a diaphragm-type air pump. Therefore, when the relative humidity of the room is 55%–65% or more, the volume of the adsorbed water 20 increases, the ink jet volume decreases and the ink jetting becomes unstable.

SUMMARY OF THE INVENTION

The present invention intends to make the ink jet volume not vary even when the room humidity increases.

That is, the present invention intends to provide an ink jet recording apparatus which comprises:

an ink nozzle plate having ink discharge channels for discharging ink, a power source for producing an electric field in the ink at the ink discharge channels, an air nozzle plate having air discharge channels, facing the ink discharge channels, for discharging air to jet the ink, and a heating means for increasing the temperature of the air nozzle plate.

Further, the present invention intends to provide an ink jet recording apparatus which comprises:

an ink nozzle plate having ink discharge channels for discharging ink, a power source for producing an electric field in the ink at the ink discharge channels, an air nozzle plate having air discharge channels, facing the ink discharge channels, for discharging air to jet the ink, and an air supply system, for supplying the air to the air discharge channels, having a humidity decreasing apparatus for decreasing water in the air.

Further, the present invention intends to provide an ink jet recording apparatus which comprises:

an ink nozzle plate having aligned ink discharge channels for discharging ink, an air nozzle plate having aligned air discharge channels, facing the ink discharge channels, for discharging air to jet the ink, an air passage formed between the ink nozzle plate and the air nozzle plate, a common first electrode formed on an outside face of the air nozzle plate, surrounding the air discharge channels, a plurality of second electrodes formed on an ink-side face of the ink nozzle plate, each second electrode surround an associated ink discharge channel, a power source for producing an electric field between the common first electrode and the plurality of second electrodes, and a heating means for heating the common first electrode.

BRIEF DESCRIPTION OF THE DRAWINGS

FIG. 2(*b*) is a partly enlarged sectional view of the conventional ink jet recording apparatus.

FIG. 3(*b*) is a sectional view of an ink jet recording apparatus of the first embodiment of the present invention.

FIG. 5(*b*) is a sectional view of an ink jet recording apparatus and a warm current device of the second embodiment of the present invention.

DESCRIPTION OF THE PREFERRED EMBODIMENT

Figure 3A:
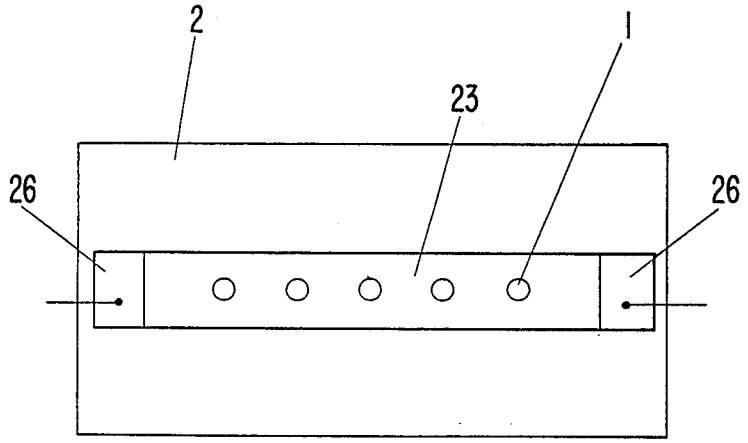
FIG. 3(*a*) is a sectional view of an ink jet recording apparatus of the first embodiment of the present invention.
Figure 3B:
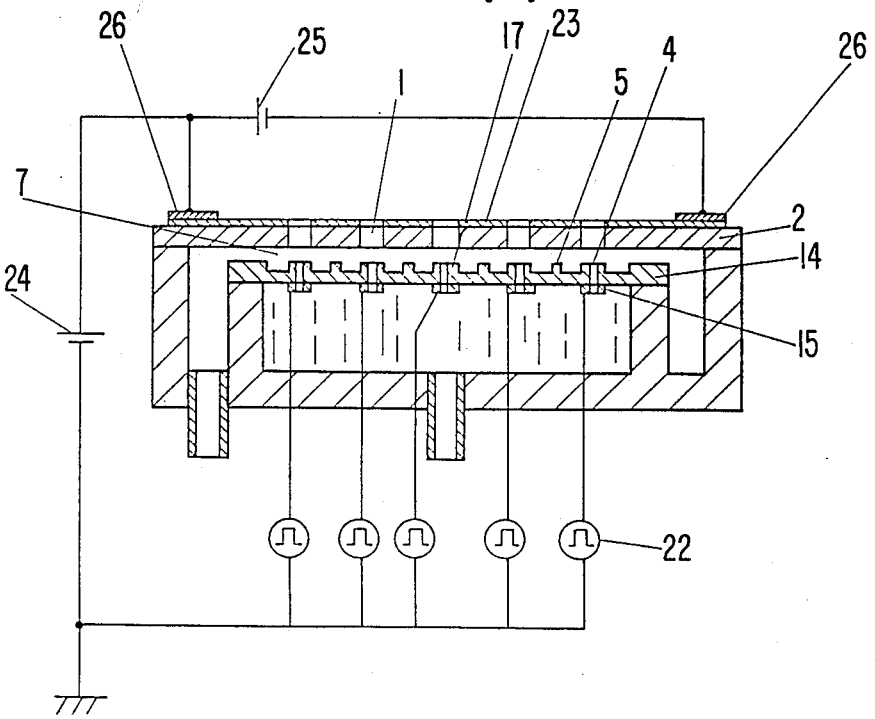

FIG. 3(*a*) is a plan view of an ink jet recording apparatus of a first embodiment of the present invention. FIG. 3(*b*) is a sectional view of an ink jet recording apparatus of the first embodiment of the present invention. A common electrode 23 serving also as a heat device (abbreviated to common electrode), comprising a rectangular resistance device, is attached on an air nozzle plate 2 surrounding a plurality of air discharge channels 1 disposed in a straight line. A terminal of the common electrode 23 is connected to a positive terminal of a bias power source 24 and to a positive terminal of a heat power source 25.

Figure 1:
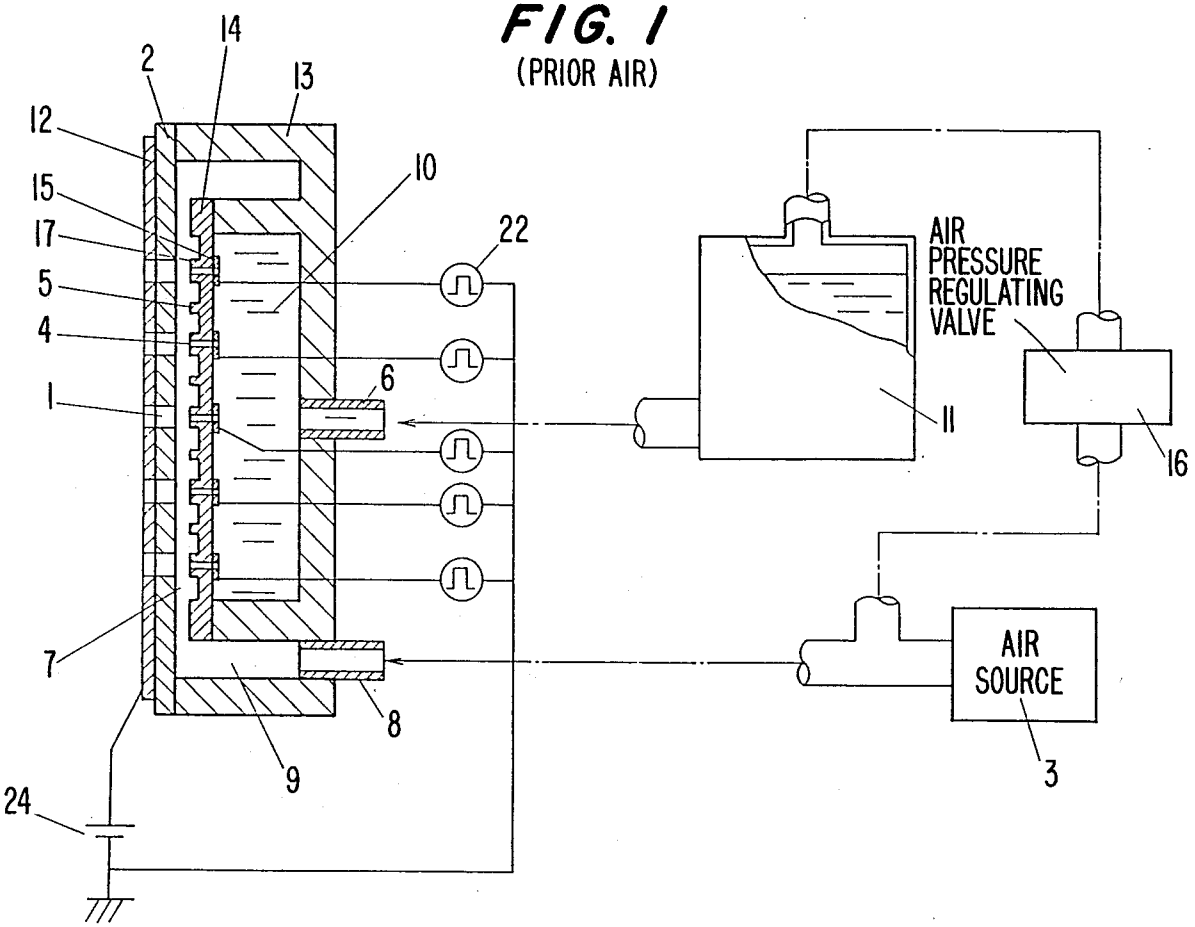
FIG. 1 is a sectional view of a conventional ink jet recording apparatus.
Figure 2A:
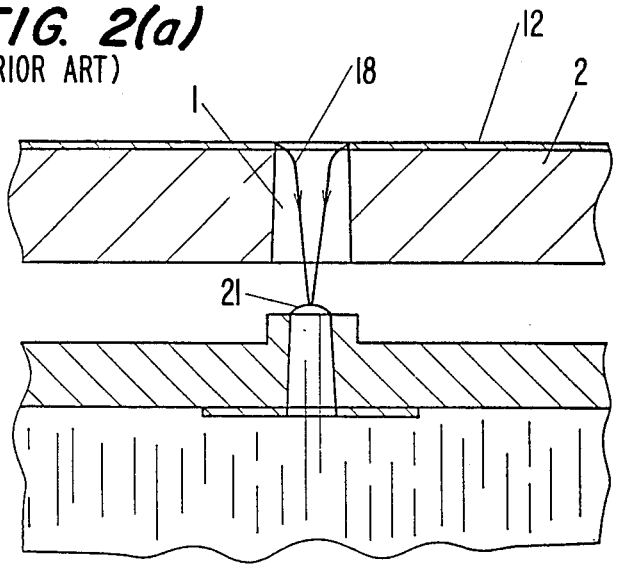
FIG. 2(a) (PRIOR ART)
FIG. 2(*a*) is a partly enlarged sectional view of the conventional ink jet recording apparatus.
Figure 2B:
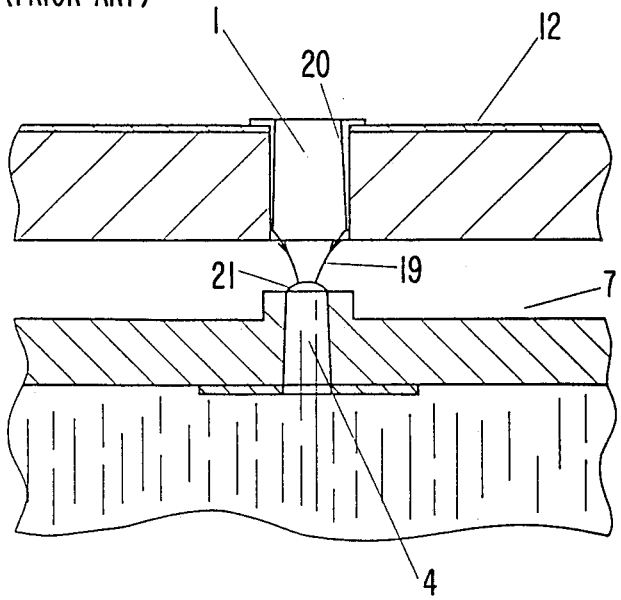
FIG. 2(b) (PRIOR ART)

The other terminal of the common electrode 23 is connected to a negative terminal of the heat power source 25. The common electrode 23 serves as a common electric electrode for applying a bias voltage and as a heating device. The common electrode 23 is connected to the power sources 24, 25 utilizing silver paste 26. Other elements constituting the ink jet recording apparatus of the present invention are similar to the conventional ink jet recording apparatus as shown in FIG. 1. The common electrode 23 is formed by depositing Cr 1000A thick on the air nozzle plate 2 by utilizing an electron beam evaporation method. The width of the common electrode 23 is 2 mm and the length of the common electrode is 19 mm, and it is formed by using a mask such that a 30 Ω resistance is obtained. The common electrode 23 has a voltage applied by the heat power source 25, thereby to heat. The heat increases the temperature of the air nozzle plate 2. For example, when the room temperature is 25° C. and the air flows, 3.5v is necessary to make the temperature of the air nozzle plate 32° C.

Figure 4:
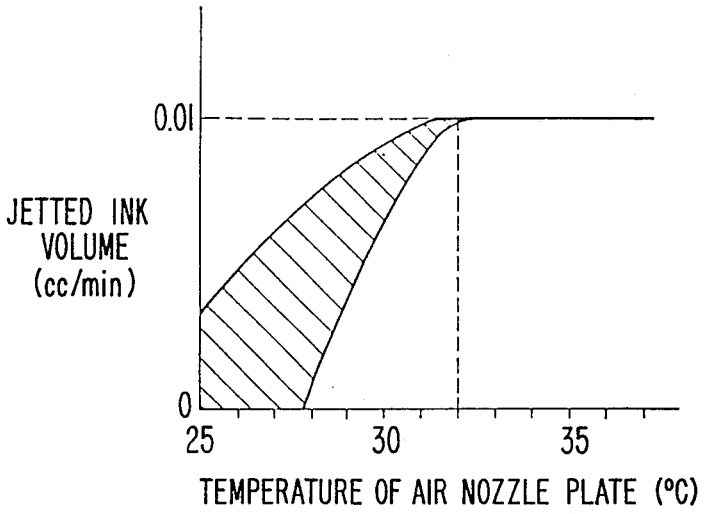
FIG. 4 is a graph of a relation between temperature of an air nozzle plate and ink jet volume in the first embodiment of the present invention.

FIG. 4 is a graph of the relation between the temperature of the air nozzle plate 2 and ink jet volume. As shown in FIG. 4, with a room temperature of 25° C. and a relative humidity of 65%, the ink jet volume decreases and becomes unstable. But when the temperature increases, the ink jet volume increases. When the temperature is 32° C. or more, a stable ink jet volume, as with low relative humidity, is obtained. The stable ink jet volume is due to water adsorbed in the air discharge ports 1 being vaporized by heating the air nozzle plate 2. Therefore, an electric potential is not applied to the adsorbed water and the electric field is not unstable. The problem of the ink meniscus not extending because of the divergent electric field thus eliminated. When the voltage applied to the common electrode 23 is 3.5v or more, for example 5v, the temperature of the air nozzle plate 2 is high and a stable ink jet volume is obtained even when the relative humidity is 65% or more. Even when the room temperature varies, the temperature of the air nozzle plate 2 increases on the basis on the room temperature, as it is applied with heat by the common electrode 23. Thus, stable ink jet volume is obtained.

Since the common electrode 23 is provided neighboring the air discharge ports 1, the volume near the air discharge ports 1 is efficiently heated. While Cr is used as the material for the common electrode 23 in the above-mentioned embodiment, other materials can be used, that is, materials with a specific resistivity of several tens $\mu\,\Omega$ cm-100$\mu\,\Omega$ cm, for example Ti(50$\mu\,\Omega$ cm), Hf(29.6$\mu\,\Omega$ cm) and Ni-Cr (100$\mu\,\Omega$ cm) are suitable. The specific resistivity of Cr is 18.9$\mu\,\Omega$ cm. The shape of the common electrode 23 is not limited to rectangular and other shapes can be used, considering resistance or temperature distribution.

Figure 5B:
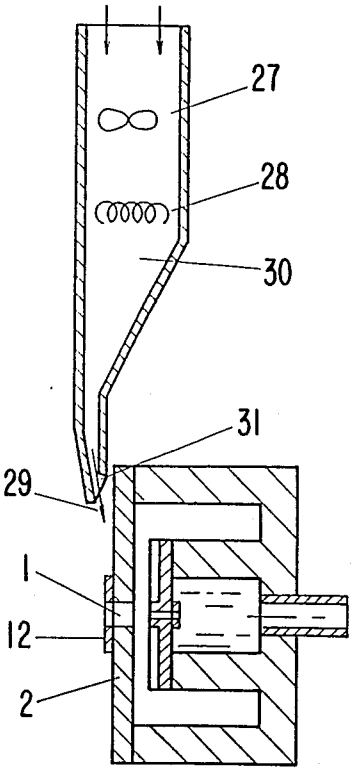
FIG. 5(*a*) is a front view of an ink jet recording apparatus and a warm current device of a second embodiment of the present invention.
Figure 5A:
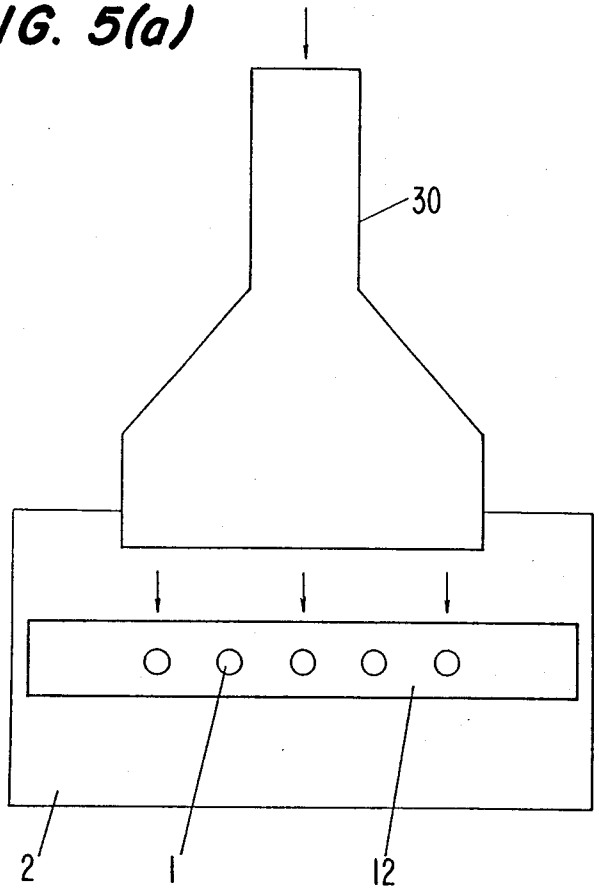

FIG. 5(*a*) is a plan view of the ink jet recording apparatus of another embodiment of the present invention. FIG. 5(*b*) is a sectional view of the ink jet recording apparatus of this embodiment of the present invention.

A warm current device 30 comprises a fan 27, a heater 28 and a nozzle 31. The fan 27 blows air, the heater 28 heats the air and the warmed air 29 is jetted from the nozzle 31. The warm current device 30 is disposed so as to blow the warmed air 29 on the air nozzle plate 2 of the ink jet recording apparatus. Other elements of the ink jet recording apparatus are similar to the conventional ink jet recording apparatus of FIG. 1.

When the ink jet volume is unstable because of high relative humidity (large water (moisture) volume in the atmosphere), the water adsorbed near the air discharge ports 1 is vaporized by increasing the temperature of the air nozzle plate 2 utilizing the warmed air 29. Therefore, the electric field is formed so as to efficiently extend the ink meniscus and stable ink jet volume is obtained irrespective of the humidity in the atmosphere.

The common electrode 23 formed on the air nozzle plate 2 or the warm current device are used as the method for increasing the temperature of the air nozzle plate 2 in the above-mentioned embodiments. Other methods for increasing the temperature of the air nozzle plate 2 can be used. For example, a resistance device for heating, a ceramic heater, an infrared lamp or a band heater covered with insulating material may be attached to the air nozzle plate 2.

Figure 6:
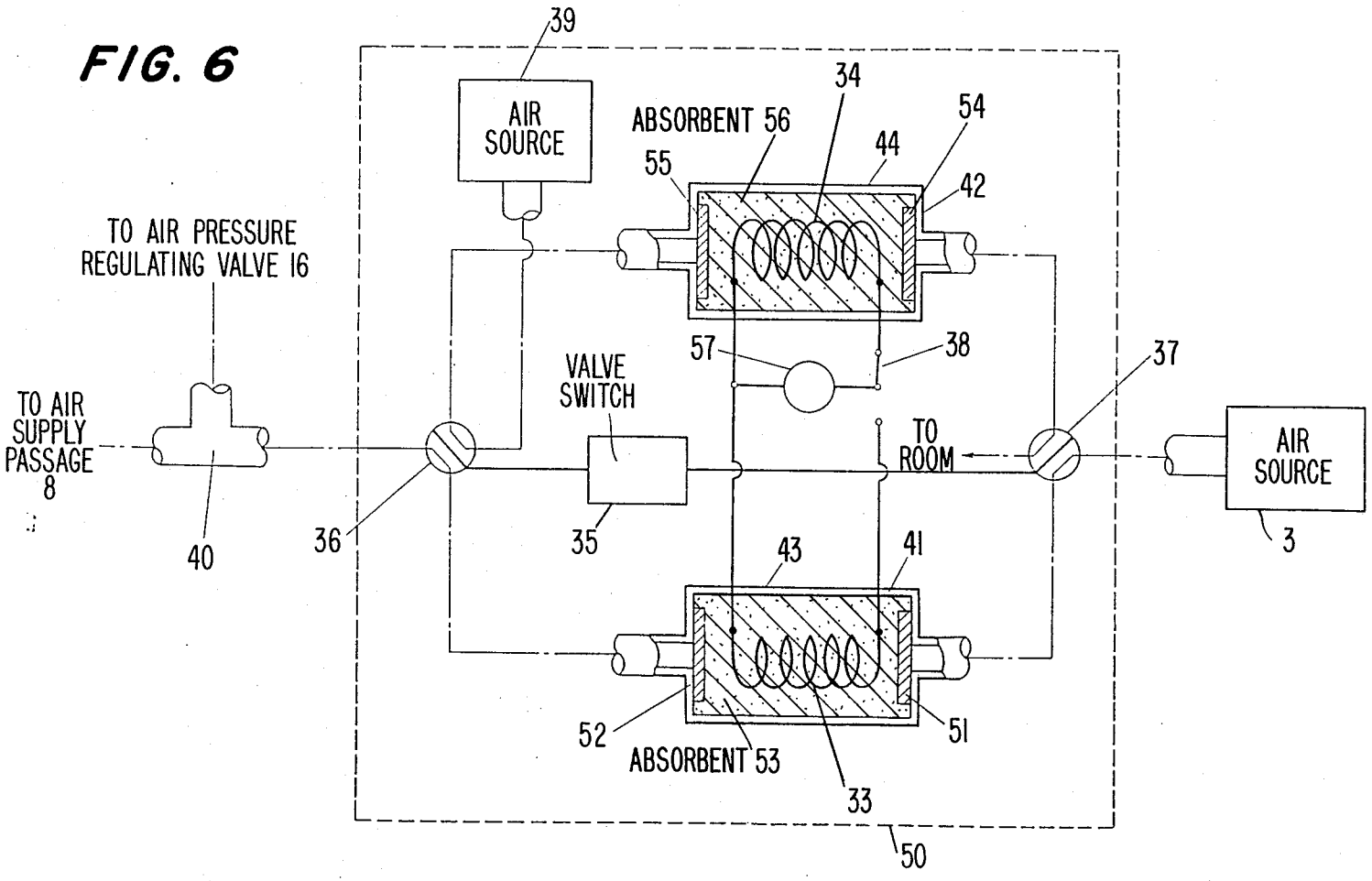
FIG. 6 is a block diagram of an ink jet recording apparatus of a third embodiment of the present invention.

FIG. 6 is a block diagram of an air supply system of another embodiment of the present invention. A humidity decreasing apparatus 50 is provided between the air source 3 and a three way conduit 40. Other elements are similar to that of FIG. 1. The humidity decreasing apparatus 50 includes a humidity decreasing system and a reclamation system. The humidity decreasing apparatus 50 interchanges the two systems, thereby successively decreasing the water volume in the atmosphere and decreasing the relative humidity.

Referring to the humidity decreasing system, the air source 3 takes air from the room, increases the pressure and blows the air into absorbent container 41 through a four-way valve 37. A casing of the adsorbent container 41 has a filter 51, 52 at the inlet and outlet thereof to prevent loss of an absorbent 53. The absorbant 53 absorbs water from the air, thereby decreasing the relative humidity. A heater 33 for reclamation is buried in the absorbent 53. When a moderate size globule of silica gel is used as the absorbent 53 in the filler case 41 having a volume of 500cm$^3$, the relative humidity of air at 25° C. and 60% humidity is reduced to 20%. The humidity reduced air passes through the fourway valve 36 and enters into the three-way conduit 40.

Referring to the reclamation system, the air source for reclamation 39 takes air from the room, increases the pressure and blows the air into absorbent container 42 through a four-way valve 36. A casing of the container 42 has a filter 54, 55 at the inlet and outlet thereof to prevent loss of an absorbent 56, for example silica gel. A heater 34 is buried in the absorbent 56. By driving a heater switch 38 of the heater 34 a voltage from power source 57 is applied to the heater 34. Then the absorbent 56 is heated to 100° C. or more and the air passes through the adsorbent 56. Thus the absorbent 56, whose capability of absorbing water is reduced on account of water, is reclaimed. The air passed through the absorbent container 42 flows out into the room through the four-way valve 37. The absorbent 56 is reclaimed for about 10 minutes. Then, after 10 minutes the heater switch 38 is switched off and the air source for reclamation 39 stops the air supply. When the temperature of absorbent 56 returns to room temperature by natural cooling the reclamation of the abosorbent 56 is completed.

While the container 41 operates as the humidity decreasing system, the container 42 operates as a reclamation system. Conversely, while the container 42 operates as the humidity decreasing system, the container 41 operates as a reclamation system. The interchange of the humidity decreasing system and a reclamation system is executed by switching the four-way valves 36, 37 with the valve switch 35 and the heater switch 38 among heaters 33, 34. Thus the absorbents 53, 56 repeat the absorbing and the discharge of water. The air having the reduced humidity flows into the air supply passage 8 as shown in FIG. 1 through the three way conduit 40 and is made uniform in the circular air chamber 9 and enters into the air passage 7 and finally is jetted from the air discharge channels 1. The humidity decreasing apparatus 50 reduces the water in the air, thereby to make 20% relative humidity air of 60% relative humidity air. Thus the ink jet volume is stable.

As a result, by reducing the relative humidity of the supplying air to about 50% or less, the water in the air is not adsorbed to the air discharge channel 1. The electric field is thus formed so as to efficiently extend the ink meniscus and stable ink jet volume is obtained irrespective of the humidity in the atmosphere of the room.

In the above-mentioned embodiments, silica gel is used as the absorbent 53, 56, but other material can be used, for example, alumina gel or zeolite.

What is claimed is:

1. An ink jet recording apparatus comprising:

an ink nozzle plate;

a plurality of ink discharge channels extending through said ink nozzle plate for discharging ink there through;

an ink chamber connected to and neighboring said ink discharge channels for containing ink therein;

a plurality of signal sources for applying signal voltages to the ink in each of said plurality of ink discharge channels;

an air nozzle plate formed of an electrically insulating material disposed in spaced opposed relation to said ink nozzle plate;

a plurality of air discharge channels extending through said air nozzle plate, each of said air discharge channels being substantially axially aligned with an associated one of said ink discharge channels and having an inlet and an outlet;

means for supplying air to said air discharge channels;

electrode means disposed on said air nozzle plate and at least surrounding said outlet of each of said air discharge channels, said electrode means being a strip electrode having a resistivity within the range of approximately 18.9 to 100 $\mu\Omega$ cm;

a first power source means electrically connected between said electrode means and said plurality of signal sources for providing an electrical field between said electrode means and the ink in said ink discharge channel; and a second power source means electrically connected between both ends of said electrode means for applying a voltage to create resistance heating in said electrode means to raise the temperature of said air discharge channels.

2. An apparatus as in claim 1, wherein said strip electrode is formed of chromium.

3. An apparatus as in claim 1, further comprising a plurality of electrodes formed on said ink discharge plate, each of said electrodes surrounding an inlet of an associated one of said ink discharge channels, and wherein each of said ink discharge plate electrodes is electrically connected, via an associated one of said signal sources, to said first power source means.

4. An ink jet recording apparatus comprising:

an ink nozzle plate;

a plurality of ink discharge channels extending through said ink nozzle plate for discharging ink there through;

an ink chamber connected to an neighboring said ink discharge channels for containing ink therein;

a plurality of signal sources for applying signal voltages to the ink in each of said plurality of ink discharge channels;

an air nozzle plate formed of an electrically insulating material disposed in spaced opposed relation to said ink nozzle plate;

a plurality of air discharge channels extending through said air nozzle plate, each of said air discharge channels being substantially axially aligned with an associated one of said ink discharge channels and having an inlet and an outlet;

means for supplying air to said air discharge channels, said means including an air supply source and an air supply passage;

electrode means disposed on said air nozzle plate and at least surrounding said outlet of each of said air discharge channels;

power source means electrically connected between said electrode means and said plurality of signal sources for providing an electric field between said electrode means and the ink in said ink discharge channel; and humidity absorbing means disposed between said air supply source and said air supply passage for reducing the humidity of air supplied to said air discharge channels, said humidity absorbing means comprising at least two containers each having an inlet portion selectively coupled to said air supply source by first value means and an outlet portion selectively coupled to said air supply passage by second value means and each of said containers containing an absorbent material and a heater, and further comprising control means for switching said first and second valve means and activating at least one of said heaters.

5. An apparatus as in claim 4, further comprising a plurality of electrodes formed on said ink discharge plate, each of said electrodes surrounding an inlet of an associated one of said ink discharge channels, and wherein each of said ink discharge plate electrodes is electrically connected, via an associated one of said signal sources, to said first power source means.

* * * * *